US012358685B2

(12) United States Patent
Kawabata et al.

(10) Patent No.: US 12,358,685 B2
(45) Date of Patent: Jul. 15, 2025

(54) REPLACEMENT LEAD CASE

(71) Applicant: MITSUBISHI PENCIL COMPANY, LIMITED, Tokyo (JP)

(72) Inventors: Mitsuhiro Kawabata, Fujioka (JP); Kyoichiro Nakamura, Fujioka (JP); Kiyoshi Fujisawa, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 21 days.

(21) Appl. No.: 18/257,784

(22) PCT Filed: Dec. 16, 2021

(86) PCT No.: PCT/JP2021/046527

§ 371 (c)(1),
(2) Date: Jun. 15, 2023

(87) PCT Pub. No.: WO2022/131329

PCT Pub. Date: Jun. 23, 2022

(65) Prior Publication Data

US 2024/0101307 A1 Mar. 28, 2024

(30) Foreign Application Priority Data

Dec. 17, 2020 (JP) ..... 2020-209327
Feb. 3, 2021 (JP) ..... 2021-015639
May 14, 2021 (JP) ..... 2021-082566

(51) Int. Cl.
*B65D 85/20* (2006.01)
*B65D 1/34* (2006.01)
(Continued)

(52) U.S. Cl.
CPC ..... *B65D 11/12* (2013.01); *B65D 1/34* (2013.01); *B65D 43/20* (2013.01); *B65D 85/24* (2013.01); *B65D 2543/00388* (2013.01)

(58) Field of Classification Search
CPC . B65D 1/34; B65D 5/38; B65D 43/20; B65D 83/02; B65D 85/28; B65D 85/20; B43K 19/14; B43K 31/005
(Continued)

(56) References Cited

U.S. PATENT DOCUMENTS 1,895,061 A * 1/1933 Worssam ..... A45D 33/20 206/229
3,033,355 A * 5/1962 Van Sickle ..... B65D 43/12 206/539
(Continued)

FOREIGN PATENT DOCUMENTS

FR 1.164.311 A 10/1958
JP 48-43487 Y1 12/1973
(Continued)

OTHER PUBLICATIONS

International Search Report issued Mar. 15, 2022 in PCT/JP2021/046527, filed on Dec. 16, 2021, 4 pages.
(Continued)

*Primary Examiner* — Luan K Bui
(74) *Attorney, Agent, or Firm* — Oblon, McClelland, Maier & Neustadt, L.L.P.

(57) ABSTRACT

A replacement lead case includes a case body that forms an inner space surrounded by a rear surface plate and right and left leg plates as a replacement lead accommodation room and has a lid body on the tip end thereof and a case part on a rear part thereof via a bendable thin part provided on the rear surface plate, and a cover member that has a U-shaped cross-section orthogonal to a longitudinal direction molded by a front surface plate and right and left outer leg plates covers the replacement lead accommodation room on a case body with the front surface plate and slidably supports the case body in the longitudinal direction with the leg plates positioned on the inside of the outer leg plates. A rail-shaped
(Continued)

guide is formed on the lid body along the longitudinal direction, and the cover member includes a slider that contacts the guide.

11 Claims, 13 Drawing Sheets

(51) Int. Cl.
*B65D 6/06* (2006.01)
*B65D 43/20* (2006.01)
*B65D 85/24* (2006.01)

(58) Field of Classification Search
USPC ..... 206/1.5, 443, 468; 220/345.1
See application file for complete search history.

(56) References Cited

U.S. PATENT DOCUMENTS 3,648,831 A * 3/1972 Arnone ..... B65D 43/12 220/345.2
4,932,547 A * 6/1990 Rodriguez ..... A45C 11/24 229/122
5,080,222 A * 1/1992 McNary ..... B65D 43/12 220/345.3
6,241,093 B1 * 6/2001 Yatabe ..... G11B 23/0233 206/387.1
2010/0251672 A1 * 10/2010 Weissbrod ..... B65D 85/26 206/443

FOREIGN PATENT DOCUMENTS

JP 7-17584 U1 3/1995
JP 2010-30136 A 2/2010
JP 2010-173248 A 8/2010
JP 2014-42992 A 3/2014

OTHER PUBLICATIONS

Partial supplementary European Search Report issued Oct. 11, 2024, in European Patent Application No. 21906689.1, 12 pages.

* cited by examiner

REPLACEMENT LEAD CASE

TECHNICAL FIELD

This invention relates to a replacement lead case that houses writing leads to be used in mechanical pencils and others.

BACKGROUND ART

A replacement lead case to be used in mechanical pencils and others is often composed of two components: a case body with a bottom and a lid body detachably equipped at an opening of the case body.

Patent literature 1 discloses a replacement lead case, for example, constituting two parts that are a case body made of a resin material and a lid body made of a resin material. Sliding the lid body in the direction perpendicular to the longitudinal direction of the replacement lead case releases the opening of the case body (the opening for taking out the replacement lead).

In this case, the position of the lid body against the opening of the case body can be set up in two steps, for example. This structure allows the user to set the opening to have an appropriate area for taking out the replacement leads.

Further, patent literature 2 discloses a replacement lead case similarly constituting two parts: a case body made of a resin material and a lid body made of a resin material. The lid body is detachably attached to the opening of the case body with a bottom.

The opening (the opening for taking out the replacement lead formed on the case body) is cut at an angle on the front side. This structure allows the user to pick up replacement leads with the fingertips, making a replacement lead case easy to use.

CITATION LIST

Patent Literature

PTL 1: JP-A-2010-30136
PTL 2: JP-A-2010-173248

SUMMARY OF INVENTION

Technical Problem

In all of the replacement cases disclosed in the above patent literature, it is necessary to tilt the case body so that the replacement lead outlet faces slightly downward while the replacement lead outlet is open. The replacement leads are taken out from the case body by utilizing the replacement leads coming out to the outlet due to their gravity of themselves.

This procedure requires a subtle operation of rocking the case body while adjusting the inclination of the case body. This operation may cause more replacement leads than necessary or all the replacement leads inside the case to come out from the replacement lead outlet and scatter on the floor; in some cases, the user is forced to pick up and return replacement leads scattered on the floor.

This invention is made in response to the problems mentioned above of conventional replacement lead cases. The objective is to provide a replacement lead case that allows the user to easily take out the required replacement leads without directing the replacement lead outlet downward and prevents a large number of replacement leads from coming out simultaneously from the case body, whereby the problems of the conventional replacement lead cases are eliminated.

Solution to Problem

A preplacement lead case according to the present invention for solving problems recited above is characterized in that the replacement lead case includes a case body, in which the inner space enclosed by a back plate and the right and left leg plates is used as a replacement lead accommodation room, and a lid body is formed on the tip side and a case part is on the rear side via a bendable thin-walled portion placed near the tip of the rear plate in the longitudinal direction, and a cover member which is formed in a U-shaped cross-section perpendicular to the longitudinal direction by the front face plate and the right and left outer leg plates, and in which the replacement lead accommodation room on the case body is covered by the front face plate, and which is slidably supported in the longitudinal direction by positioning the leg plates of the case body inside the outer leg plates, wherein a guide is formed along the longitudinal direction on either one of at least one of the leg plates of the lid body or the outer leg plate of the cover member that covers the leg plate, and also a sliding body in contact with the guide is formed on either one or the other, and with the sliding action of advancing the lid body of the case body from the tip of the cover member, the sliding contact of the sliding body against the guide causes the lid body to pivot to warp the lid body toward the rear plate through the thin-walled portion.

In this case, in a preferable embodiment, it is desirable that an inner lid body is further provided, which is fixed to the right and left leg plate of the case body and covers the replacement lead accommodation room at the front face side thereof and protrusions to avoid surface contact with the stored replacement leads are formed on the inner surface of the replacement lead accommodation room side of the rear plate of the case body and the inner surface of the replacement lead accommodation room side of the inner lid body.

Further, in the inner lid body, a pair of protection plates are desirably formed so as to respectively locate the inside of the right and left leg plates from the thin-walled portion of the case body to the lid body.

Meanwhile, the guide is preferably formed, projecting in a rail-like form and extending along the longitudinal direction outside the leg plates of the lid body. Further, the preferred form of a locking portion is formed, protruding to be in contact with the guide at the tip portion of the cover member from which the sliding action advances the lid body. By forming an inclined region in the guide that is getting away from the rear plate from the tip end toward the thin-walled portion, the sliding action causes the lid body to pivot motion to warp toward the rear plate through the thin-walled portion.

In this case, more preferably, at the contacting portion with the sliding body in the guide, a parallel region parallel to the rear plate is formed at the tip end side, and the inclined region is formed continuously from the parallel region. With this structure, the former half of the sliding action does not cause the lid body to pivot motion and allows it to move to advance the lid body from the tip end of the cover member, and the latter half of the sliding action causes the lid body to pivot motion to warp toward the rear plate.

In a preferable embodiment, a blocking plate is formed to close the tip end by connecting the right and left leg plates at the tip end side of the lid body, and the blocking plate is visibly recognizably disposed at the tip end of the cover member, in a state where the lid body is accommodated in the cover member and the front face plate of the cover member is viewed from the front.

Further, it is desirable that the case body and the cover are both made of resin material, a group of a large number of line protrusions is formed in a direction orthogonal to the longitudinal direction on the backside of the rear plate of the case body, and a circular-shaped recess, for example, is formed on the surface of the front face plate of the cover member.

Further, it is desirable that a rib for sliding is formed along the longitudinal direction of the inner lid body on the outer surface of the inner lid body, and the inner bottom face of the cover member has a matte-finished surface.

In another embodiment of the replacement lead case of this invention, the case body is provided with an operation part protruding outwardly from the leg plate. Moving the operation part relative to the longitudinal direction of the cover member achieves a sliding motion to advance the lid body of the case body from the tip end of the cover member.

Due to the provision of right and left legs integrally formed on both sides of the main plate, the replacement lead case of this invention uses a member as a part of the replacement lead case, the member which is formed in a U-shaped cross-section perpendicular to the longitudinal direction and has inward projections integrally formed on the left and right leg plates facing inward the leg plates, wherein, on an inner bottom face of the main plate which is located between the right and left leg plates of the replacement lead case part, a first step portion having a step against the inner bottom face is formed along the right and left leg plates except for a central portion of the longitudinal direction of the inner bottom face.

In one preferred embodiment, a structure is employed where on the opposing inner surfaces of the right and left leg plates, a second step portion with a step against the inner surface is formed continuously from the first step portion.

Further, on the inner bottom face of the main plate located between the right and left leg plates, a third step portion, which has a different concavo-convex direction from the first step portion, is formed at a position where it does not overlap the first step. In this case, a structure is adopted that the first step portion is preferably formed protruding from the inner bottom face, and the third step portion is formed recessed to the inner bottom face.

Advantageous Effects

According to the replacement lead case of the present invention described above, a replacement lead case is formed by slidably mounting the case body, which is formed of a lid body and a case part via a bendable thin-walled portion, to the inside of the cover member. By forming a guide and sliding member slidable to each other by sliding action on one or the other of the lid body and the cover member, the sliding action causes the lid body to pivot motion to warp toward the rear face plate.

Consequently, the tip portions of the replacement leads are exposed projecting from the case part by the pivot motion of the lid body due to the thin-walled, whereby necessary replacement leads can be easily taken out.

Accordingly, since this allows taking out replacement leads without tilting the case body slightly downward, a replacement lead case can be provided which overcomes the problem conventional ones have where a lot of replacement leads fly out simultaneously from the case body, for example.

An inner lid body is additionally attached to the case body to cover the replacement lead accommodation room on the front side.

Protrusions are formed on the inner surfaces of the case body and the inner lid body to avoid surface contact with the replacement leads, which effectively eliminates the problem of replacement lead sticking to the inside of the replacement lead accommodation room due to static electricity. With this structure, compared to the case where protrusions are formed respectively on opposing surfaces in a single part, forming the case body and the inner lid body with two parts allows for avoiding the problem of causing damage to opposing protrusions when forcibly extracting at releasing from the mold.

On the inner lid body, a pair of protection plates located from the thin-walled of the case body to the lid body are respectively formed on the inner side of the right and left leg of the case body. This structure effectively overcomes the problem of replacement leads being pinched between the leg plate of the lid body warping toward the backside and the leg plate of the case when the lid body advanced by the sliding action is retracted into the cover member.

Other advantageous effects of the invention will be explained each time in the paragraphs of the embodiment for carrying out the invention, together with the description of the examples.

DESCRIPTION OF EMBODIMENTS

A replacement lead case according to the present invention will be described based on drawings.

Figure 21:
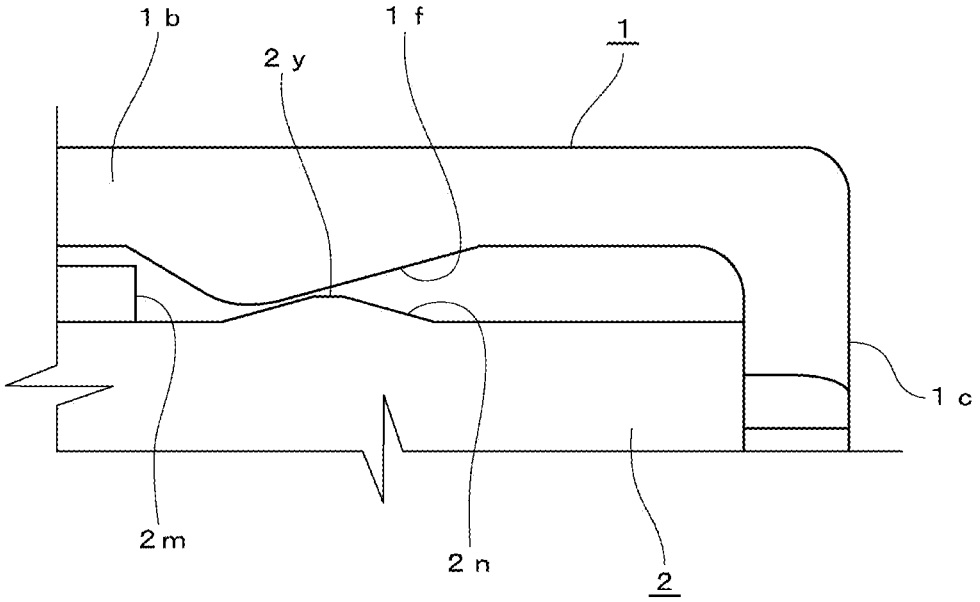
FIG. 21 is an enlarged view of the backside corner of the replacement lead case.
Figure 22:
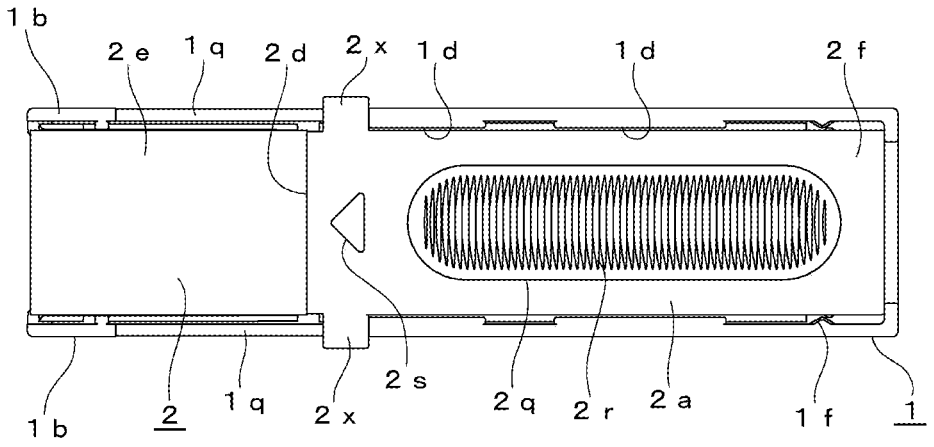
FIG. 22 is a back view of a replacement lead case of the second embodiment.
Figure 23:
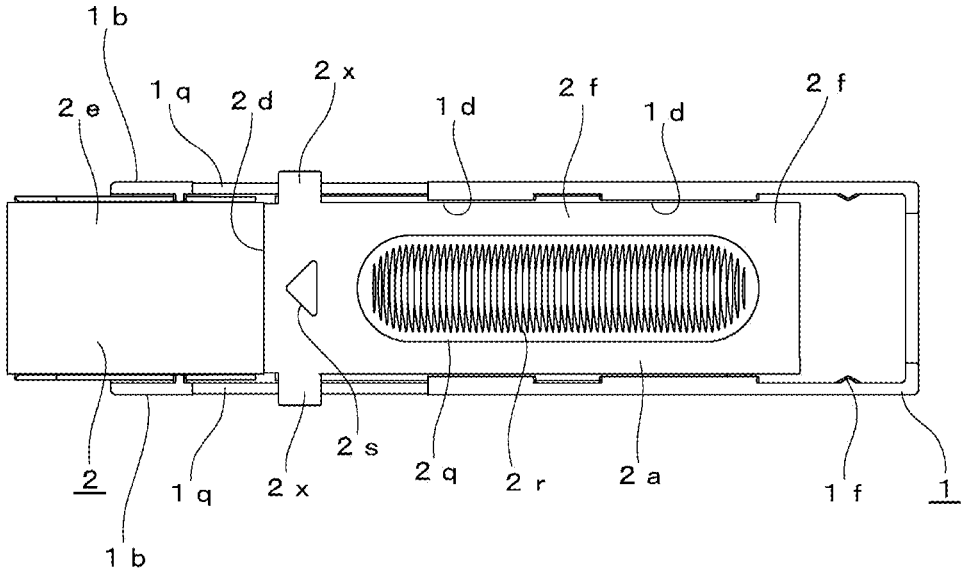
FIG. 23 is a back view illustrating the replacement lead case in a state where a lid body is advanced halfway.

FIGS. 1 through 21 show a replacement lead case of the first embodiment, FIGS. 22 and 23 show a replacement lead case of the second embodiment. FIGS. 24 through 29 show an example of a method of forming parts of the replacement lead case and replacement lead cases to be obtained.

First, the first embodiment of the replacement lead case will be described based on FIGS. 1 through 21.

Figure 1:
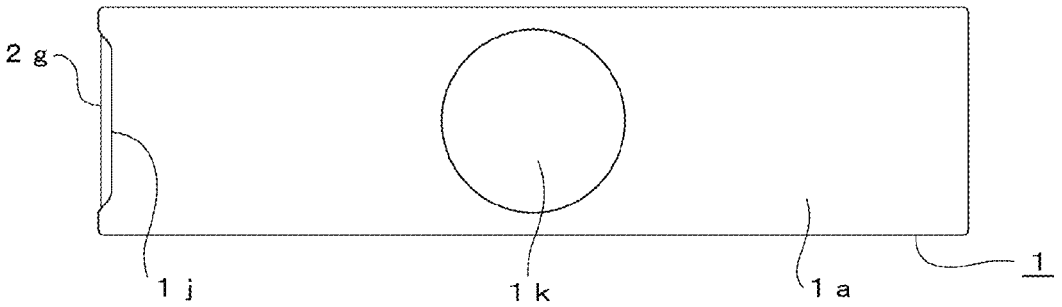
FIG. 1 is a front view of a replacement lead case of the first embodiment according to the present invention.
Figure 2:
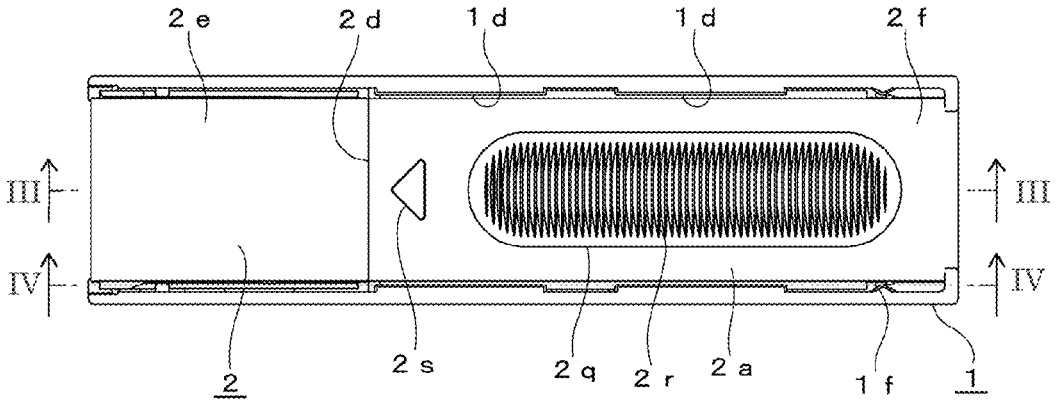
FIG. 2 is a back view of the replacement lead case thereof.

FIGS. 1 and 2 show the whole constitution of the replacement lead case viewed from the front side of the cover member 1 and the back side of the case body 2.

In this embodiment, the cover member 1 and the case body 2 are made of resin material, and an inner lid body 3 described later which is attached to the case body 2 and covered with the cover member 1 is similarly made of resin material. The case body 2 and the inner lid body 3 are slidably attached to the cover member 1 along the longitudinal direction of the cover member 1 to form a replacement lead case.

In the following, one end of the case body 2 in the longitudinal direction along which a lid body 2*e*, which will be described later, is advanced from the cover member 1 is referred to as a tip portion for convenience of explanation, and the other end is referred to as a rear portion.

FIGS. 10 through 19 show the single part configuration of the case body 2, the inner lid body 3, and the cover member 1, and the detailed configuration of each part will be described based on the drawings showing the single part configurations.

Figure 10:
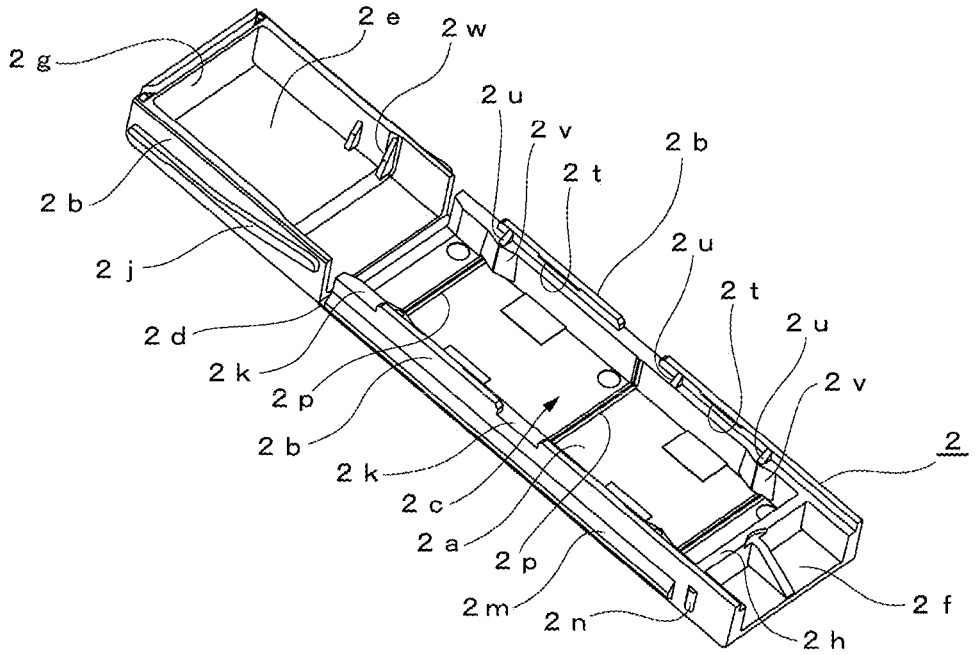
FIG. 10 is a perspective view illustrating the single part configuration of a case body constituting the replacement lead case.
Figure 11:
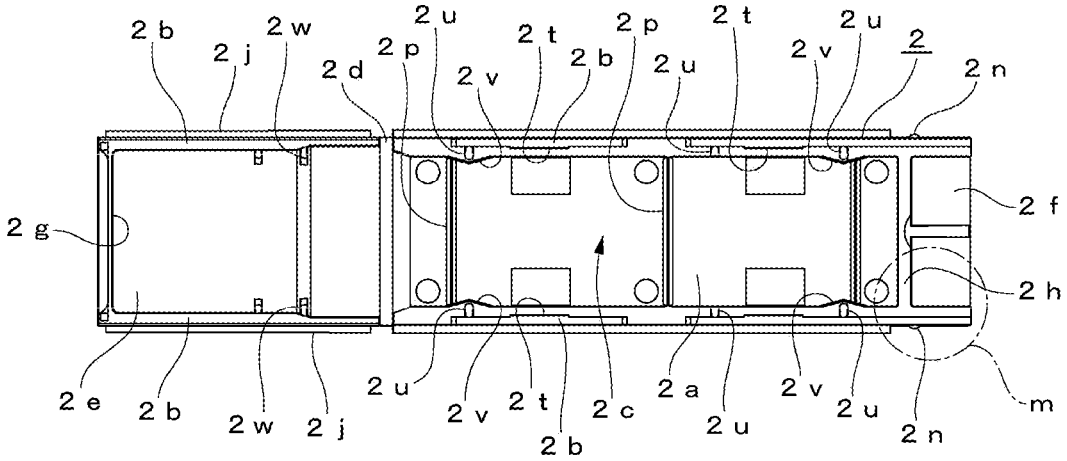
FIG. 11 is a front view thereof.
Figure 12:
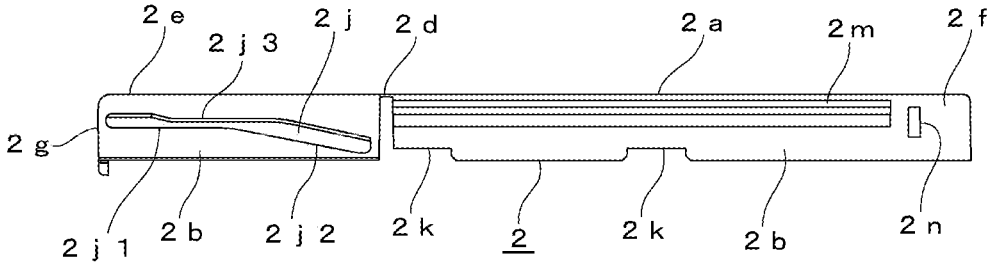
FIG. 12 is a top view thereof.
Figure 13:
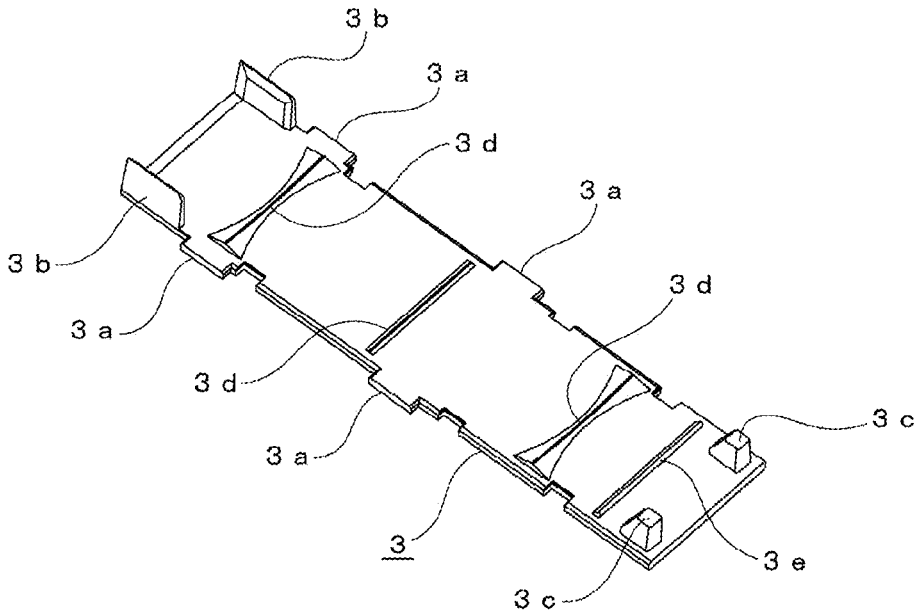
FIG. 13 is a perspective view illustrating the single part configuration of an inner lid body.

FIGS. 10 to 12 show the case body 2, and the case body 2 is formed with a rear face plate 2*a* and right and left leg plates 2*b* to have a U shape cross-section perpendicular to the longitudinal direction, and the inner space enclosed in the U-shape forms a replacement lead accommodation room 2*c*.

The lid body 2*e* at the tip portion and a case part 2*f* at the rear portion are formed through the bendable thin-walled portion 2*d* which is formed near the tip portion in the longitudinal direction of the rear plate 2*a*.

Further, a blocking plate 2*g* is formed on the lid body 2*e* to close the tip portion of the lid body 2*e* by connecting the right and left leg plates 2*b*, and a rear blocking plate 2*h* is formed at the rear portion of the case part 2*f* to close the rear portion of the case part 2*f* by connecting right and left leg plates 2*b*.

A guide 2*j* is respectively formed outside the right and left leg plates 2*b* of the lid body 2*e*, protruding like a rail along the longitudinal direction. As shown in FIG. 12, at the tip portion side of the lid body 2*e*, the guide 2*j* has a parallel region 2*j*1 that is parallel to the rear plate 2*a*, and an inclined region 2*j*2 following the parallel region 2*j*1 is formed, leaving from the rear plate 2*a* as toward the thin-walled portion 2*d*.

The parallel region 2*j*1 and the inclined region 2*j*2 of the guides 2*j* operate so as to cause the lid body 2*e* to pivot motion of warping toward the rear side through the thin-walled portion 2*d*, with sliding on the sliding body 1*g* provided on the cover member 1 along with the sliding action of advancing the lid body 2*e* of the case body 2 from the tip portion of the cover member 1 which will be described later.

On the left and right leg plate 2*b* in the case part 2*f*, fitting recesses 2*k* are formed for attaching the inner lid body 3 described below at a position nearly the center of the longitudinal direction and further at a position close to the lid body 2*e*.

Further, a pair of sliding protrusions 2*m* is formed along the longitudinal direction of the case body 2 on both outer sides of the right and left leg plates 2*b* of case part 2*f*. The sliding protrusion 2*m* is engaged with a case support 1*d* described below on the cover member 1, and the case body 2 is supported slidably in the longitudinal direction.

At a position near the rear portion of the right and left leg plates 2*b* of the case part 2*f*, a rib-like clicking protrusion 2*n* is formed, and when the cover member 1 is slid against the case body 2, the clicking protrusion moves over a clicking body if so that the click action is generated. Accordingly, the click action is also generated when the case body 2 is returned to the cover member 1.

Further, on the inner surface of the replacement lead accommodation room 2*c* at the rear plate 2*a* of the case part 2*f*, multiple protrusions 2*p* are formed to avoid surface contact with the stored replacement leads so as to be perpendicular to the longitudinal direction of the case body 2. The multiple protrusions 2*p* prevent the replacement leads L from being adsorbed to the inner surface of the replacement lead accommodation room 2*c* of the case body made of resin material by static electricity.

Further, on the backside of the rear plate 2*a* of the case body 2, a concave part 2*q* is formed at the rear half portion along the longitudinal direction as shown in FIG. 2, a group 2*r* of a large number of line protrusions is formed, being arrayed in a direction orthogonal to the longitudinal direction of the case body 2 in the concave part 2*q*. An arrow mark 2*s*, preferably triangular, is formed at the tip portion side of the concave part 2*q*.

The arrow mark 2*s* shows the sliding direction of the case body 2 relative to the cover member 1, and the group of linear protrusions 2*r* functions as an anti-slip device to the finger at the sliding operation.

Inward ribs 2*t* are formed each toward the inside of the case body 2 on the right and left leg plates 2*b* of the case body 2. The inward rib 2*t* generates a fitting force of the inner lid body 3 against the case body 2 by filling the gap between the case body 2 and the inner lid body 3 by contacting the side edge of the inner lid body when the inner lid body 3 described later is attached to the case body 2. This structure improves the fixing force because inward ribs 2*t* become unremovable when disassembled.

Respectively three inclined protrusions 2*u* are integrally formed with the case body 2 along the upper edge, the same plane as the fitting recess 2*k*, so to say, of the right and left leg plates 2*b* on the case part 2*f* side of the case body 2. The protrusion plane of each of the inclined protrusions 2*u* inclines inward from the outside of the case part 2*f*.

Further, mountain-like protrusions 2*v* are formed respectively opposing each other on the inner surface of the right and left leg plates 2*b*, close to the inclined protrusion 2*u* at the front end side and back end side of the case part 2*f*. Further, rib-like protrusions 2*w* are also formed respectively opposing each other inside the right and left leg plates 2*b* on the lid body 2*e* side of the case body 2.

Any of the inclined protrusions 2*u*, mountain-like protrusions 2*v*, and rib-like protrusions 2*w* function to prevent replacement leads particularly from breaking when replacement lead cases are assembled by an automatic assembly machine, in a state where a predetermined number of replacement leads are stored in the replacement lead accommodation room 2*c* of the case body 2.

Namely, for the assembly of the replacement lead case with an automatic assembly machine, a predetermined number of replacement leads are charged, aligning to the longitudinal direction of the case body 2, in the replacement lead accommodation room 2*c* of the case body 2 placed on a horizontal plane. Then a process step accompanies fitting the inner lid body 3 to the case body 2 by pressing the inner lid body 3 from the above to the case body 2 being in the above state. Further, by placing the cover member 1 over the inner lid body 3 to cover the upper portion thereof, the replacement lead case as goods is assembled, in which the leg plates 2*b* of the case body 2 are housed inside the outer leg plates 1*b* of the cover member 1 and the case body 2 is slidably supported against the cover member 1.

Accordingly, since the protruding surface of the inclined protrusion 2*u* is inclined to lower from the outside to the inside of the case part 2*f*, the placement of replacement leads, formed long and thin, is hindered on the same plane as the fitting concave 2*k*; this structure acts to house all the replacement leads charged in the replacement lead L accommodation room 2*c* of the case body 2.

The mountain-like protrusion 2*v* and the rib-like protrusion 2*w* function as a guide to lead the replacement leads L, fed in the replacement lead accommodation room 2*c*, to the central area of the replacement lead accommodation room 2*c* without touching the right and left leg plates 2*b*. This function prevents the pair of right and left protection plates 3*b* formed in the inner lid body 3 from pinching the tip end of the replacement leads fed in the replacement lead accommodation room 2*c* in the process of fitting the inner lid body 3 to the case body 2. This action prevents the lead breakage of the replacement leads L and the occurrence of defectiveness of goods as the replacement lead case.

FIGS. 13 through 16 show the single part configuration of the inner lid body, which is attached to the right and left leg plates 2*b* of the case body 2 and covers the replacement lead accommodation room 2*c* at the front side.

The inner lid body 3 is formed flat, and rectangular-shaped fitting protrusions 3*a* are respectively formed at the center of the longitudinal direction thereof and near the tip portion. The fitting protrusions 3*a* are fitted to the inner lid body concave portions 2*k* formed in the case body 2 to position the inner lid body 3 to the case body 2 and are attached to cover the replacement lead accommodation room 2*c* of the case body 2 at the front side.

At this time, the pair of protection plates 3*b* formed at the tip portion of the inner lid body 3 is disposed to position over from the thin-walled portion 2*d* of the case body 2 to the lid body 2*e* inside the right and left leg plates 2*b* of the case body 2.

As recited in the section about the advantageous effects, this configuration allows effectively overcoming the problem of pinching the replacement leads L between the leg plate 2*b* on the lid body 2*e* warping to the rear and the leg plate 2*b* of the case part 2*f* when the lid body 2*e* advanced by the sliding action is returned to the inside of the cover member 1.

A pair of spacers 3*c* formed protruding on the inner surface of the inner lid body 3 act to maintain a certain distance between the inner lid body 3 and the rear face plate 2*a* of the case body 2 at the back end of the inner lid body 3.

Further, multiple protrusions 3*d* are formed on the inner surface of the inner lid body 3 in the direction perpendicular to the longitudinal direction of the inner lid body 3. The multiple protrusions 3*d* prevent the replacement lead L from surface contacting with the inner lid body 3 made of a resin, which covers the replacement lead accommodation room 2*c* of the case part 2*f* from the front side and prevents the replacement leads L from sticking to the inner lid body 3 by adsorbing due to static electricity.

Further, a rib-like stopper 3*e* protruding from the inner surface of the inner lid body 3 is formed in the immediate vicinity of the pair of spacers 3*c* on the inner lid body 3.

In a state where the inner lid body 3 is attached to the case body 2, the stopper 3*e* locates just in front of the gap formed between the case body 2 and the rear end of the inner lid body 3 and functions to prevent the replacement leads L stored in the replacement lead accommodation room 2*c* from coming out from the replacement lead case.

Figure 16:
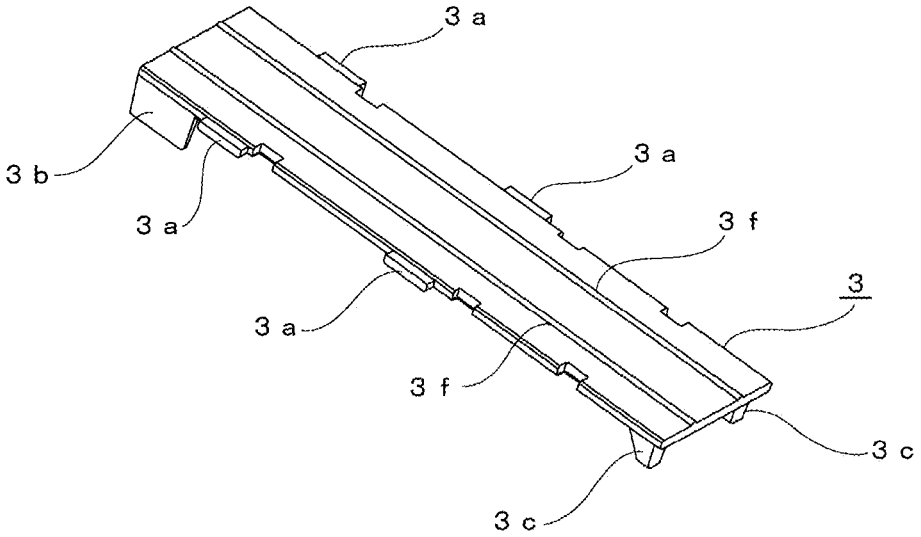
FIG. 16 is a perspective view of the inner lid body viewed from the outside.

FIG. 16 is a perspective view of the inner lid body 3 from the outside. Two ribs 3*f* for sliding formed parallel to each other on the outer surface of the inner lid body 3.

Accordingly, in a state where the inner lid body 3 is attached to the case body 2, the two ribs 3*f* for sliding locate on the outer surface of the inner lid body 3. The two ribs for sliding 3*f* function to obtain an appropriate sliding resistance when the ribs 3*f* for sliding slide along the longitudinal direction against a matte-finished surface formed on the inner bottom face 1*m* of the cover member 1, described later.

Figure 17:
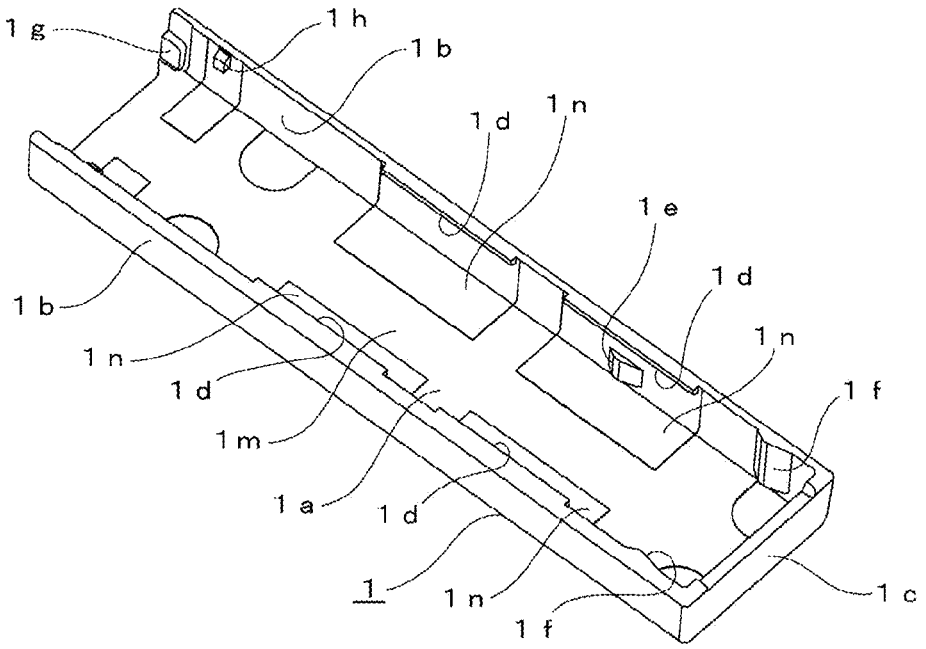
FIG. 17 is a perspective view illustrating the single part configuration of the cover member.
Figure 18:
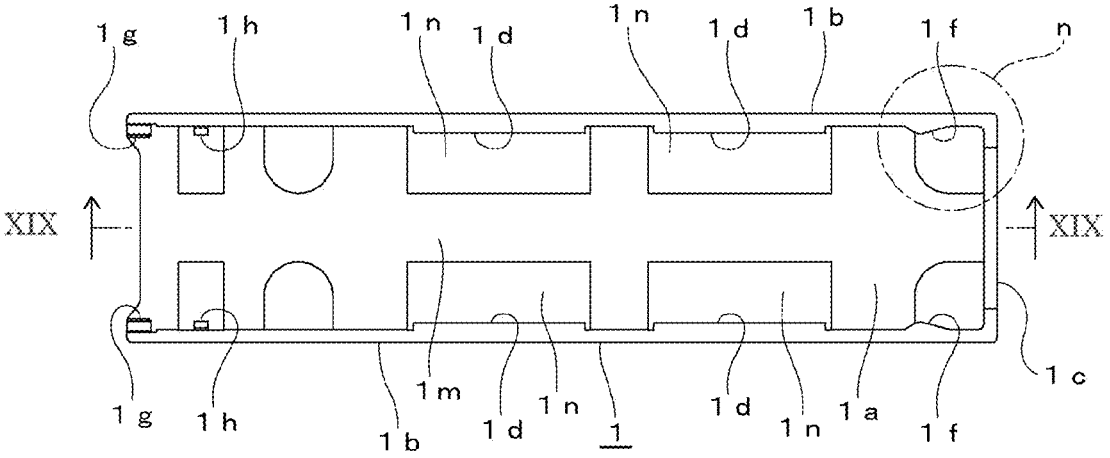
FIG. 18 is a front view of the single part configuration of the cover.
Figure 19:
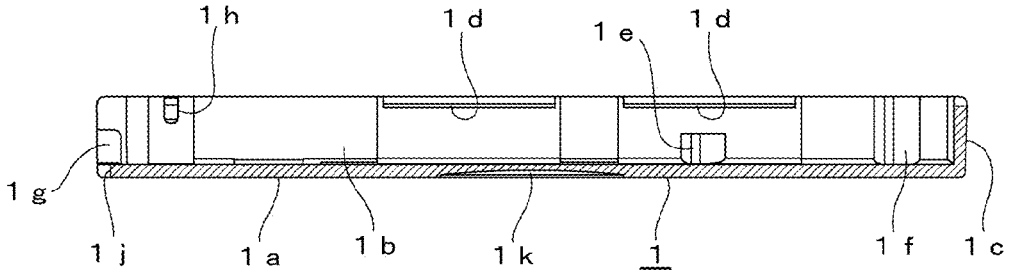
FIG. 19 is a cross-sectional view of the single part configuration of the cover in the arrow direction from the XIX-XIX line of FIG. 18.

FIGS. 17 through 19 show a single part configuration of the cover member 1. The cover member 1 has a U-shaped cross-section perpendicular to the longitudinal direction composed of a front face plate 1*a* and right and left outer leg plates 1*b*. At the end portion of the cover member 1, a rear leg plate 1*c* is formed, connecting the right and left leg plates 1*b*. Covering the replacement lead accommodation room 2*c* of the case body 2 with front face plate 1*a* and also positioning the right and left leg plates 2*b* of the case body 2 inside the right and left outer leg plates 1*b*, whereby the case body 2 is supported slidably in the longitudinal direction.

It is constructed that the sliding action allows the lid body 2*e* of the case body 2 to advance from the tip portion of the cover member 1.

Case supports 1*d* facing each other inward are formed at two positions along the longitudinal direction of the edge portion of the right and left outer leg plates. By supporting the right and left sliding protrusions 2*m* formed on the leg plates 2*b* of the case body 2, the case supports hold the case body 2 slidably and function to prevent the case body from coming off from the cover member 1.

Further, a pair of sliding protrusions 1*e* are formed facing each other on the inner surface of the right and left outer leg plates 1*b* near the rear part. The rib-shaped clicking protrusions 2*n* formed on the case body 2 climb over the sliding protrusions forward, causing the sliding protrusions 1*e* to generate a clicking action when the case body 2 is set to an open state.

Further, near the rear part inside the outer leg plates 1*b*, a pair of clicking bodies 1*f* are formed facing each other. When the case body 2 is slid, the rib-like clicking protrusions 2*n* formed on the case body 2 get over backward, and the clicking body 1*f* generates a click action.

On the inside of the outer leg plates 1*b* at the tip portion of the cover member 1, a pair of sliding bodies 1*g* are formed, protruding facing each other. When the case body 2 is slid, and the cover 2*e* protrudes from the tip portion of the cover member 1, the sliding body 1*g* function to warp the cover 2*e* toward the rear plate, being in contact with the parallel region 2*j*1 and the inclined region 2*j*2 of the guide 2*j* formed on the lid body 2*e*. The details of the action thereof will be described later based on FIGS. 4 through 7.

A pair of stoppers 1*h* are formed slightly closer to the backside of the sliding bodies 1*g* at the tip portion of the cover member 1, facing each other.

The pair of the stoppers 1*h* stops the sliding action of the case body 2 by abutting the tip portion (See FIG. 7) of the sliding protrusion 2*m* formed on the leg plates 2*b* of the case 2 when the lid body 2*e* is fully opened by sliding action of the case body 2.

The pair of stoppers 1*h* returns the lid body 2*e* warped to the rear plate to a state along the longitudinal direction of the case body 2 while the sliding bodies 1*g* contact with a returning guide 2*j*3 of the guide 2*j* when the sliding action brings back the case body 2 into the cover member 1. The details of the action thereof will be described later based on FIGS. 4 through 7.

On the inner bottom face 1*m* of the cover member 1 surrounded by the left and right outer leg plates 1*b*, rectangular flat protrusions 1*n* slightly protruding against the inner bottom face 1*m*, as shown in FIGS. 17 and 18, are formed intermittently along the left and right outer leg plates 1*b*, excluding the center of the longitudinal direction of the inner bottom face 1*m*.

The inner bottom face 1*m* of the cover member 1 is formed to be a matte-finished surface. The rib 3*f* for sliding formed on the outer surface of the inner lid body 3 described above slides on the matte-finished surface formed on the inner bottom face 1*m* of the cover member 1 along the longitudinal direction of the rib 3*f*.

The matte-finished surface formed on the inner bottom face 1*m* of the cover member 1 preferably has an arithmetic average roughness (Ra) ranging from 5 μm to 50 μm. When the value is smaller than 5 μm, the surface becomes nearly specular, and the contact resistance increases, which may cause a risk that the inner lid body 3 may not slide smoothly. When the value is more than 50 μm, mold releasing becomes difficult, and good transferability of the metal mold surface (matte-finished surface) becomes difficult to obtain. The arithmetic average roughness (Ra) in the range of 10 μm to 25 μm is even more preferable in that excellent mold releasing property and transferability of the metal mold surface are obtainable.

The matte-finished surface may be obtainable through etching, sandblasting, and non-mirror polishing to the metal mold. Further, the matte-finished surface is also achievable by leaving the surface of the mold after discharge processing without polishing.

The arithmetic average roughness (Ra) of the matte-finished surface denotes the arithmetic average roughness (Ra) defined by JIS (Japanese Industrial Standards) B0601: 1980. The surface roughness is measured using a device SJ-301 manufactured by Mitutoyo Corporation.

By setting the detaching force of the cover member from the case body to be not less than 15 N, the cover member is not detached easily from the case body, and the falling of the parts is prevented.

On the surface of the front face plate 1*a* of the cover member 1, a circular-shaped recess 1*k* is formed at approximately the center of the cover member 1, as shown in FIG. 1.

The recess 1*k* and the group of linear protrusions 2*r* on the case body 2 allow smooth slide operation by relatively sliding the case body 2 by putting the thumb on the recess 1*k* and also the indexing finger on the group of linear protrusions 2*r* when operated to slide the case body 2 against the cover member 1.

As shown in FIGS. 1 and 2, when the case body 2 is housed in the cover member 1, in the front view of the front face plate 1*a* of the cover member 1 (shown in FIG. 1), the blocking plate 2*g* of the lid body 2*e* formed at the tip portion of the case body 2 is visible along the tip-end cut out 1*j* formed at the tip portion of the cover member 1.

According to this, matching the color of the resin forming the case body 2 to the color of the replacement lead L housed in the replacement lead case nearly the same may allow the user to identify the color of the lead housed in the replacement lead case by the coloring of the blocking plate 2*g*.

Varying the color density of the resin forming the case body 2 in accordance with the hardness of the replacement lead L stepwise allows the user to identify the hardness by the color density of the blocking plate 2*g*. The color thereof is defined as within ten in hues, and within three in lightness and saturation in the Munsell color system. The density is to be the measurement results of the density of the surface of the parts by measuring with a densitometer such as sakura DENSITOMETER PDA-65 manufactured by KONISHI-ROKU PHOTO INDUSTRY CO., LTD. The hardness of the leads is to be the hardness measured by the method defined following JIS S 6005:2007.

FIGS. 3 through 9 illustrate the open and close action of the lid body 2*e* mainly when the case body 2 is slid against the cover member 1.

Figure 3:
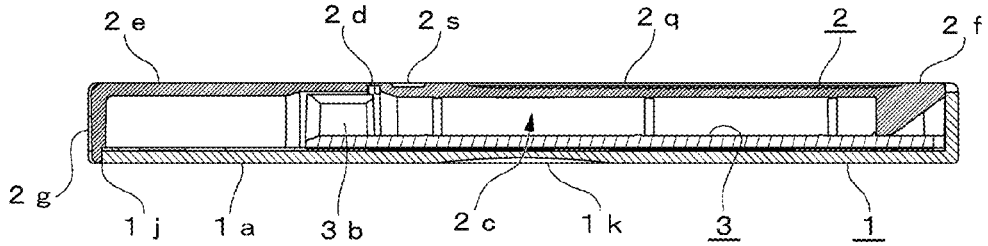
FIG. 3 is a cross-sectional view of the replacement lead case in the arrow direction from the III-III line of FIG. 2.
Figure 4:
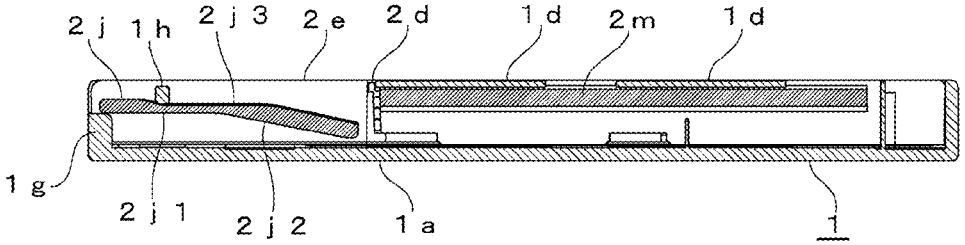
FIG. 4 is a cross-sectional view of the replacement lead case in the arrow direction from the IV-IV line of FIG. 2.

FIG. 3 is a central cross-sectional view of the case body 2, to which the inner lid body 3 is attached, housed in the cover member 1 (viewed from the a-a line of FIG. 2), and FIG. 4 is a cross-sectional view of the same of FIG. 3 along one of the guides 2*j* formed on the lid body 2*e* (viewed from the b-b line of FIG. 2).

In the state where the case body 2 is housed in the cover member 1 as shown in FIG. 4, the stopper 1*h* of the cover member 1 is in contact with the return guide 2*j*3 of the guide 2*j*, and therefore, the lid body 2*e* maintains the closed state along the longitudinal direction of the cover member 1.

Figure 5:
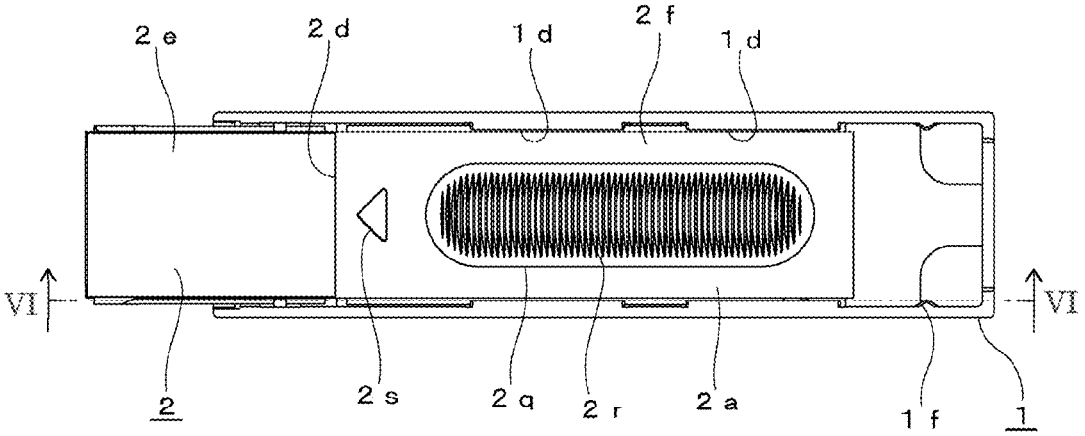
FIG. 5 is a back view of the replacement lead case in the state where a lid body is advanced halfway viewed from a case body.
Figure 6:
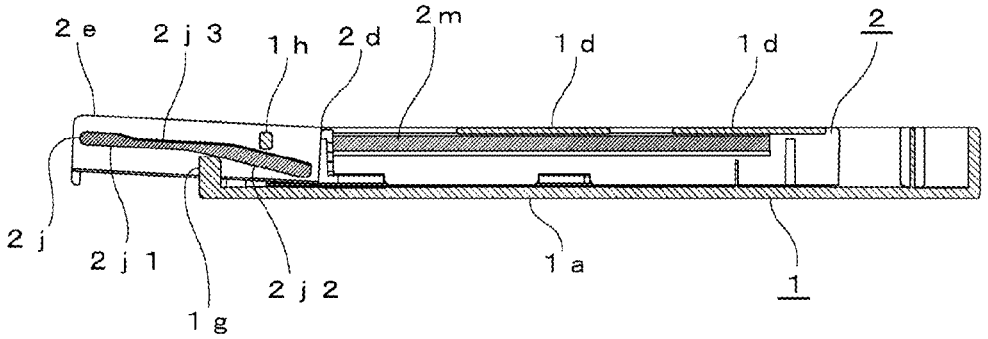
FIG. 6 is a cross-sectional view of the replacement lead case in the arrow direction from the VI-VI line of FIG. 5.

FIG. 5 illustrates the lid body 2*e* of the case body 2 protruding from the tip portion of the cover member 1 by about half the length dimension of the lid body 2*e*. FIG. 6 shows the lid body 2*e* in the above situation. In the early stage (the former half) of protruding the lid body 2*e* from the tip portion of the cover member 1, the sliding body 1*g* slides in contact with the parallel region 2*j*1 of the guide 2*j* formed on the lid body 2*e*, which allows advancing the lid body 2*e* from the tip portion of the cover member 1 without causing pivoting action to the lid body 2*e*.

In the situation shown in FIG. 6, the sliding body 1*g* is slightly in contact with the inclined region 2*j*2 of the guide 2*j*, and thereby the lid body 2*e* is in a state warping toward the backside slightly through the thin-walled portion 2*d*.

As described above, in the early stage of protruding the lid body 2*e*, since the lid body 2*e* can be advanced from the tip portion of the cover member 1 without causing pivoting action to the lid body 2*e*, the flying out and falling of the replacement leads in the replacement lead case can be prevented even if the replacement lead case is unintentionally tilted.

Figure 7:
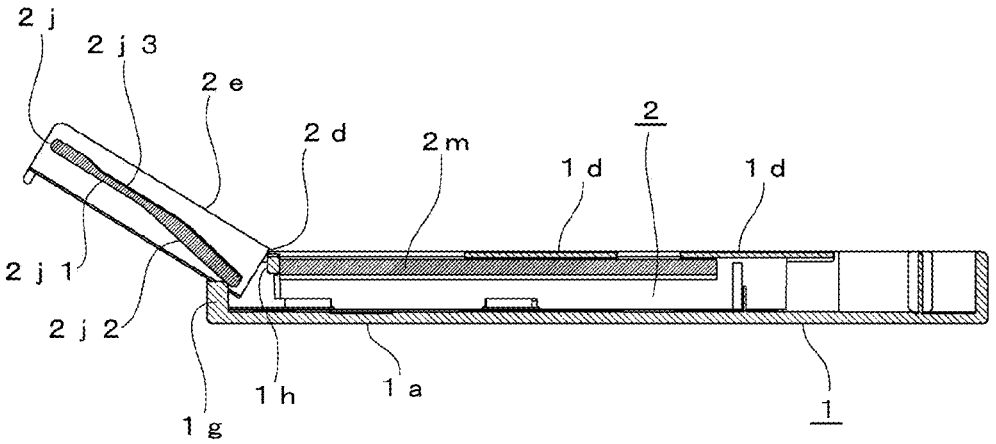
FIG. 7 is a cross-sectional view illustrating the state where the lid body is fully opened further from the state shown in FIG. 6.

FIG. 7 shows the lid part 2*e* being fully opened by further advancing the lid part 2*e* from the cover member 1. In the latter half of the advancing operation of the lid 2*e* from the state shown in FIG. 6 to the state shown in FIG. 7, the sliding body 1*g* slides along the inclined region 2*j*2 of the guide 2*j* as the cover member 1 is advanced, so that the lid body 2*e* is given a rapid pivot motion toward the backside through the thin-walled portion 2*d*.

In the state where the lid body 2*e* fully opens as shown in FIG. 7, the tip portion of the sliding protrusions 2*m* formed along the longitudinal direction of the case body 2 comes into contact with the stopper 1*h* and the advancing of the lid body 2*e* is stopped.

Figure 8:
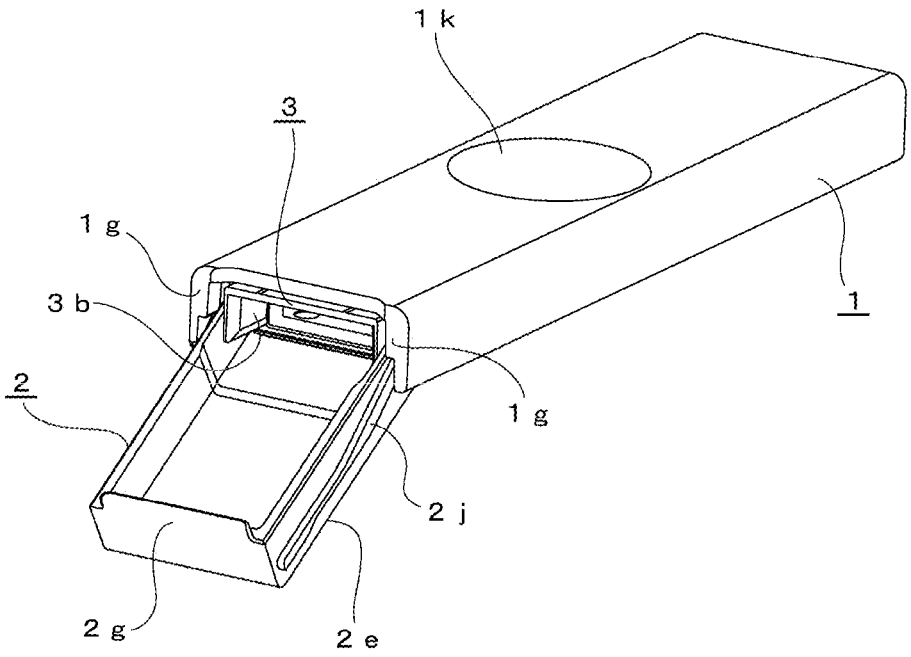
FIG. 8 is a perspective view of the replacement lead case in the state where the lid body is fully opened, viewed from a cover member.
Figure 9:
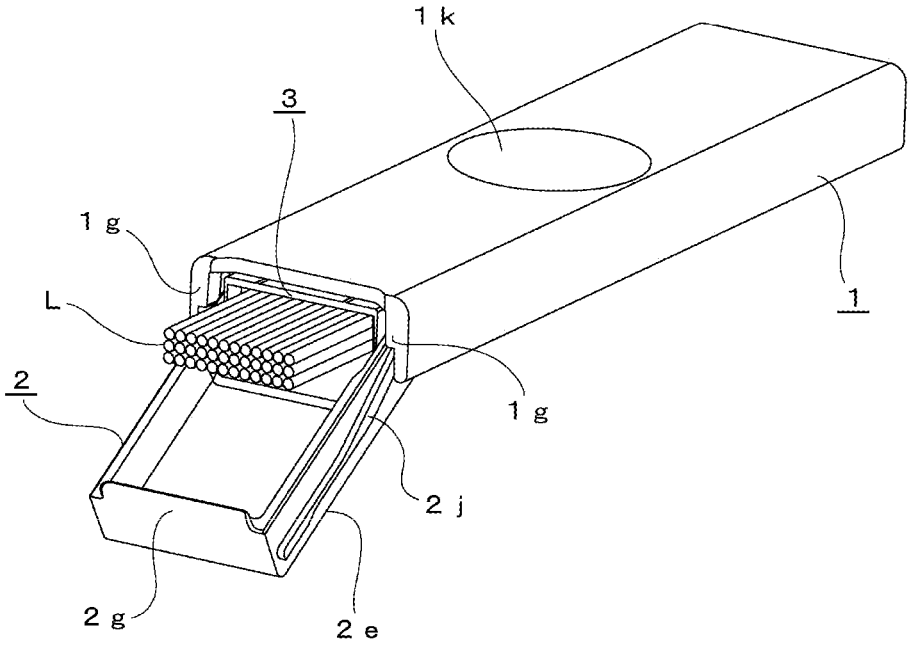
FIG. 9 is a perspective view of the replacement lead case in the same state as shown in FIG. 8 where replacement leads are housed, viewed from a cover member.

FIGS. 8 and 9 show the appearance configuration of the replacement lead case fully opened, and FIG. 9 shows the situation where replacement leads are housed in the case. In the state where the lid body 2*e* fully opens, as shown in FIG. 7, the sliding body 1*g* is in contact with the rear portion of the inclined region 2*j*2 of the guide 2*j*, and in this state, the lid body 2*e* can be further warped through the thin-walled portion with a finger, for example, as much as the user like.

As a result, the exact number of necessary replacement leads can be taken from the replacement lead case.

FIGS. 3 through 9 illustrate the open and close action of the lid body 2*e* mainly when the case body 2 is slid against the cover member 1.

FIG. 3 is a central cross-sectional view of the case body 2, to which the inner lid body 3 is attached, housed in the cover member 1 (viewed from the II-III line of FIG. 2), and FIG. 4 is a cross-sectional view of the same of FIG. 3 along one of the guides 2*j* formed on the lid body 2*e* (viewed from the IV-IV line of FIG. 2).

In the state where the case body 2 is housed in the cover member 1 as shown in FIG. 4, the stopper 1*h* of the cover member 1 is in contact with the return guide 2*j*3 of the guide 2*j*, and therefore, the lid body 2*e* maintains the closed state along the longitudinal direction of the cover member 1.

When the lid body 2*e* is returned to the cover member 1 from the fully opened state, a problem may arise that the replacement leads L are broken by pinching part of the replacement leads L housed in the case between the lid body 2*e* made via the thin-wall portion 2*d* and each of leg plates 2*b* formed on the case part 2*f*.

However, as shown in FIG. 8, the problem of breaking replacement leads L can be avoided because the pair of protection plates 3*b* formed at the tip portion of the inner lid body 3 is located inside each leg plate 2*b* of the lid body 2*e* and the case part 2*f*.

Figure 14:
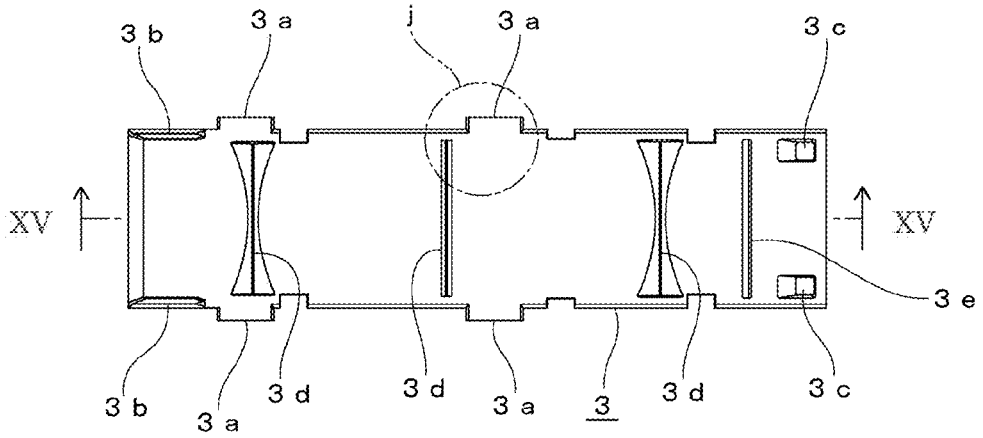
FIG. 14 is a front view of the single part configuration of an inner lid body.
Figure 15:
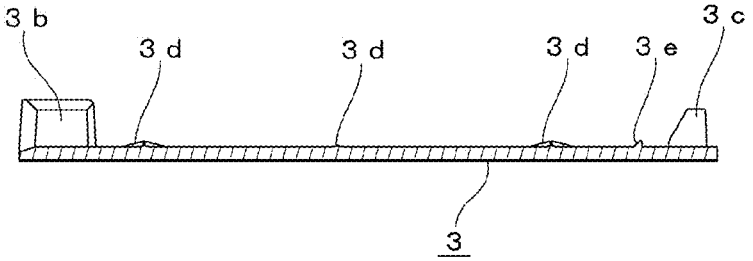
FIG. 15 is a cross-sectional view of the single part configuration of an inner lid body in the arrow direction from the XV-XV line of FIG. 14.
Figure 20:
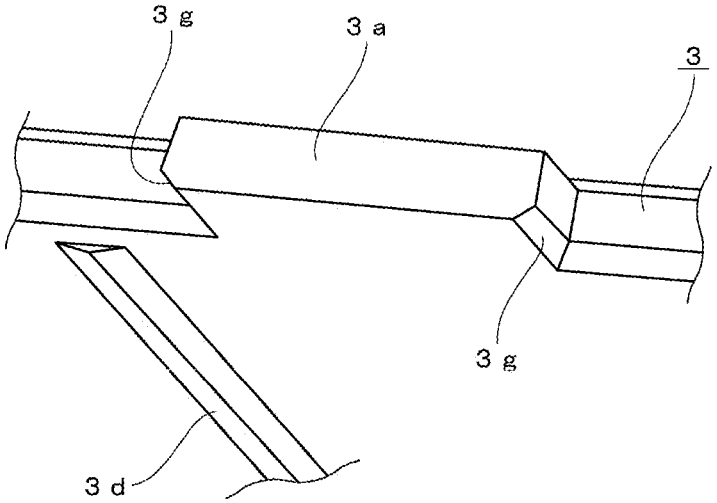
FIG. 20 is an enlarged perspective view of an enclosed region by a dot-dashed line j of the single part configuration of the inner lid body in FIG. 14.

FIG. 20 is an enlarged perspective view of an enclosed region by a dot-dashed line j in FIG. 14, and a pair of slopes 3*g* is formed on the inner surface of the rectangular-shaped fitting protrusion 3*a*.

Forming the pair of slopes 3*g* on the inner surface of the rectangular-shaped fitting protrusion 3*a* described above allows for effectively preventing positional displacement of the inner lid body 3 along the longitudinal direction against the case body 2 when assembling.

FIG. 21 is a partially enlarged view of the state in which the back side corner of the case body 2, surrounded by the dotted line m shown in FIG. 11, is attached to the corner of the cover member 1 surrounded by the dotted line n shown in FIG. 18.

As shown in FIG. 21, the clicking body 1*f* formed on the cover member 1 has a gentle slope along the longitudinal direction, and the sliding protrusion 2*n* is formed to be a trapezoid with a flat surface 2*y* at its top part.

Since the clicking body 1*f* of the cover member 1 and the sliding protrusion 2*n* of the case body 2 both have a gentle slope, the feeling of resistance when operated can be reduced at the moment of start opening to advance the lid body 2*e* of the case body 2 by sliding the case body 2 against the cover member 1.

Forming a trapezoid with a flat surface 2*y* at the top part of the sliding protrusion 2*n* of the case body 2 allows for reducing the climbing over due to the drop impact when the replacement lead case falls.

FIGS. 22 and 23 show the replacement lead case of the second embodiment viewed from the back. The parts corresponding to those of the first embodiment already described are shown with the same symbols. Therefore, a detailed explanation is omitted.

In the replacement lead case of the second embodiment, operating portions 2*x* protruding outward of the leg plates 2*b* are formed on the case body 2. It is characterized in that the sliding action is achieved to advance the lid body 2*e* of the case body 2 from the tip portion of the cover member 1 by moving the operating portions 2*x* relative to the longitudinal direction of the cover member 1.

In the case body 2, a pair of operating portions 2*x* each protruding outward are formed near the thin-walled portion 2*d* of the right and left leg plates 2*b*.

Guiding recesses 1*q* are formed along the right and left outer leg plates 1*b* by cutting out part of each of the outer leg plates 1*b* in the vicinity of the tip portion of the right and left out leg plates 1*b* of the cover member 1. In a state where the case body 2 is attached to the cover member 1, a pair of operating portions 2*x* formed on the case body 2 are positioned at the guiding recess 1*q* and slidably disposed in the guiding recess 1*q*.

Accordingly, by moving the operating portions 2*x* relative to the longitudinal direction of the cover member 1, the sliding action of advancing the lid body 2*e* of the case body 2 from the tip portion of the cover member 1 is possible. The utilization of the operating portions 2*x* allows for easily achieving the sliding action of the case body 2 against the cover member 1, and a replacement lead case excellent in operation can be provided.

In the replacement lead case according to the first and second embodiments, the case body 2 is slidably attached to the cover member 1 when the inner lid body 3 is attached to the case body 2. The inner lid body 3 is not always necessary and can be omitted.

In the case the inner lid body 3 is used, the inner lid body 3 can be connected to the rear portion of the case body 2 via a thin-walled connecting band (not shown) to form integrally. Folding back the thin-walled connecting band to assemble the inner lid body 3 to the case body 2 can reduce the number of parts, facilitate manufacturing management, and provide a replacement lead case capable of reducing cost.

Figure 24:
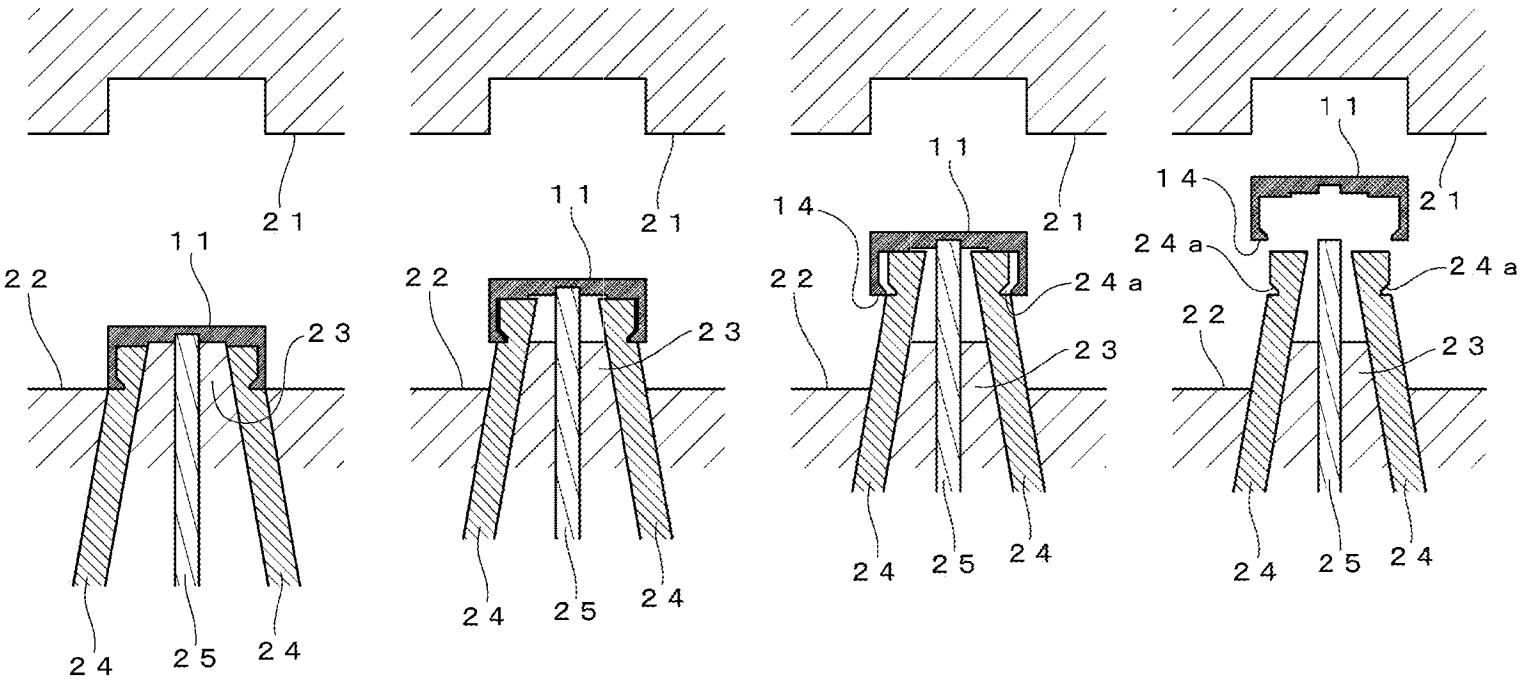
FIG. 24 is a schematic view illustrating a forming method of the parts of the replacement lead case in a processing order of (A) to (D)
Figure 25:
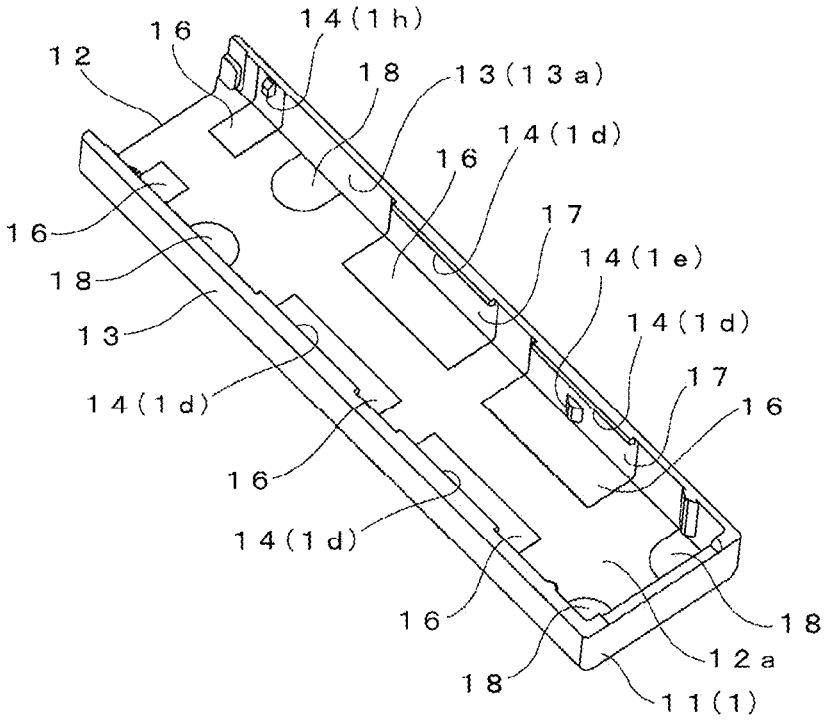
FIG. 25 is a perspective view illustrating parts of the replacement lead case obtained by the method shown in FIG. 24.
Figure 26:
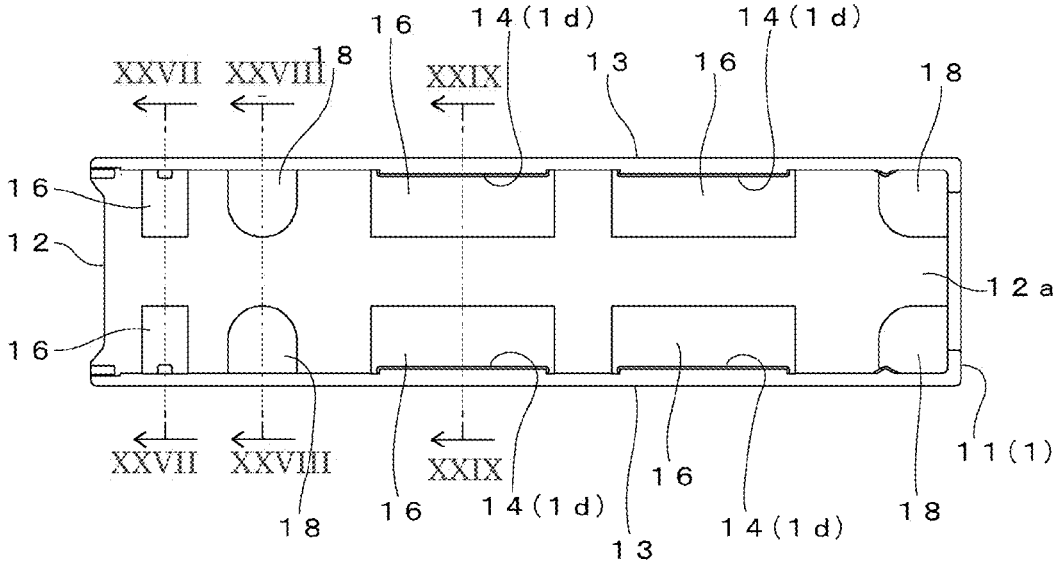
FIG. 26 is a front view of parts of the replacement lead case obtained by the method shown in FIG. 24.
Figure 27:
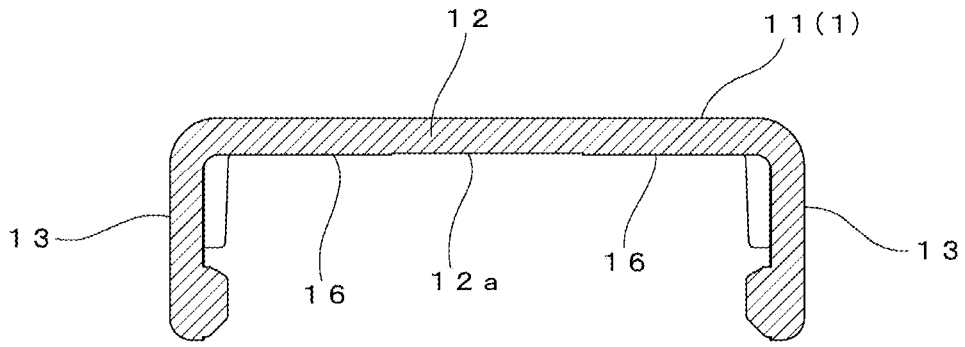
FIG. 27 is a cross-sectional view viewed in an arrow direction from the XXVII-XXVII line in FIG. 26.
Figure 28:
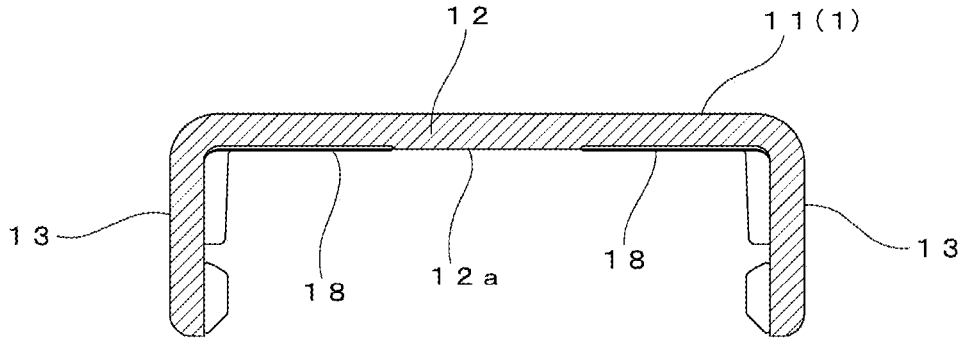
FIG. 28 is a cross-sectional view viewed in an arrow direction from the XXVIII-XXVIII line in FIG. 26.
Figure 29:
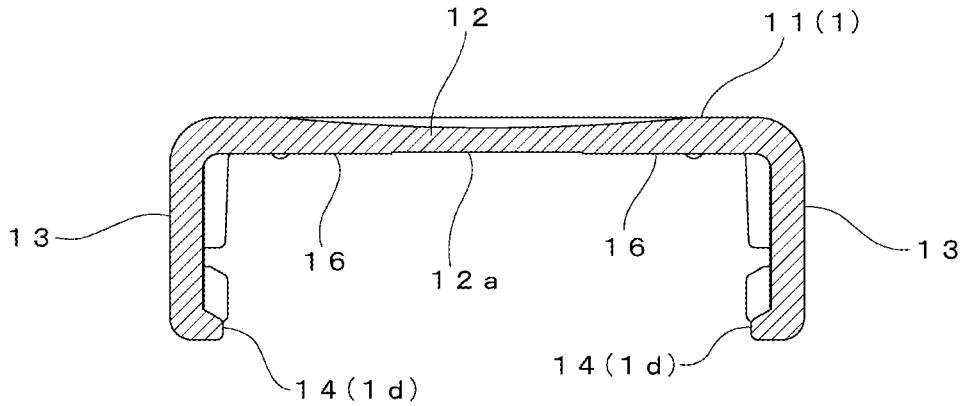
FIG. 29 is a cross-sectional view viewed in an arrow direction from the XXIX-XXIX line in FIG. 26.

FIG. 24 is a schematic diagram of an example of the method of molding parts of the replacement lead case including the cover member 1 or case body 2 following the order of processes (A) through (D). FIGS. 25 through 29 show an example of the replacement lead case part 11 obtained by the molding method.

First, the method of forming the replacement lead case part 11 shown in FIG. 24 is suitable for forming a replacement lead case part that is formed in a U-shaped cross-section perpendicular to the longitudinal direction by integrally providing the left and right outer leg plates 1*b* on both sides of the front face plate 1*a*, such as the cover member 1 that forms part of the replacement lead case already described. It is particularly suitable for molding replacement lead case parts in which the inward protrusions 14 of the case support 1*d*, for example, are integrally molded to face inward on the left and right outer leg plates 1*b* of the cover member 1.

In the following description of a molding method for replacement lead case parts, the cover member 1 and the case body 2, described above, are referred to as replacement lead case part 11, the front face plate 1*a* of the cover member 1 and the rear face plate 2*a* of the case body 2 are referred to as a main face plate 12. Further, the right and left outer leg plates 1*b* of the cover member 1 and the right and left leg plates 2*b* of the case body 2 are referred to as the leg plates 13, and the case supports 1*d* inwardly formed on the outer legs 1*b* of the cover member 1, sliding protrusions 1*e* and the stopper 1*h* are referred to as inward protrusions 14.

FIG. 24 is a schematic diagram of a resin molding apparatus illustrating the status of forming the replacement lead case part 11 as the cover member 1, previously described.

The resin molding apparatus is provided with a first mold 21 as a movable mold, a second mold 22 mounting core pins 23 forming an isosceles trapezoid, a pair of slide cores 24 which move upward along the core pins 23 in an inclination direction against the mold opening direction of the first mold 21 against the second mold 22, and an ejector pin 25 which moves upward in the same direction as the mold opening direction of the first mold 21 against the second mold 22.

FIG. 24(A) to 24(D) show the status after opening the first mold 21 from the second mold 22. In the preceding resin injection process, the resin is injected into the cavity where the first mold is closed with the second mold.

In this case, the cavity is formed in a space surrounded by the first mold 21, the second mold 22, the core pins 23, the slide core 24, and the ejector pin 25, which compose the resin injection apparatus shown in FIG. 24(B).

FIG. 24(B) illustrates the initial state where the pair of slide cores 24 and the ejector pin 25 move simultaneously to the opening direction of the first mold 21.

As shown in FIG. 24(C), from the initial state above, the pair of slide cores 24 and the ejector pin 25 further move upward without changing their relative height. This movement causes the tip portion of the pair of the slide cores 24 to move to come nearer to each other toward the central part of the replacement lead case part 11.

The movement allows the inwardly protruding portion 14 of the replacement lead case part 11 to be released from the recesses 24*a*, which are respectively formed outwardly in the vicinity of the tip of the slide cores 24, and the replacement lead case part 11 is received by the tip of the ejector pin 25.

In the state shown in FIG. 24(C), the inward protrusions 14 as an undercut formed on the replacement lead case part 11 can be vertically released from the slide cores 24. Therefore, the resin-formed replacement lead case part 11 is taken out without difficulty by a robot arm (not shown) or other means, as shown in FIG. 24(D).

According to the forming method of the replacement lead case part, the release of the replacement lead case part 11 is accompanied by the movement of the slide cores 24 toward the central part of the replacement lead case part 11. With this movement, the inward protrusions 14 integrally formed with the replacement lead case part 11 can smoothly be released from the slide cores 24 and received by the ejector pin 25.

The replacement lead case part 11 having inward protrusions 14 can be released without forcibly pulling out, and replacement lead case part 11 can be obtained to prevent from deformation of the inward protrusions 14 due to forcibly pulling out.

FIGS. 25 through 29 show examples of replacement lead case part 11 obtained by the forming method, and this part corresponds to the cover member 1 described above.

In the replacement lead case part 11, on an inner bottom face 12*a* of the main face plate 12 held between the right and left leg plates 13, rectangular first step portions 16 having large and small protruding steps due to injection molding on the inner bottom face 12*a* are formed at six locations along the right and left leg plates 13 except for the central portion along the longitudinal direction of the inner bottom face 12*a*.

Further, on the opposing inner side surfaces 13*a* of the right and left leg plates 13 of the replacement case part 11, second step portions 17 having steps due to injection molding on the inner side surfaces 13*a* are formed continued from the step portions 16. Further, on the inner bottom face 12*a* of the main face plate 12 held between the right and left leg plates 13, third step portions 18, which have a concavo-convex direction different from that of the first step portion 16, that is, having a semi-cylindrical shape molded recessed against the inner bottom face 12*a* are formed at four locations deviated from the first step portions 16.

The inner bottom face 12*a* of the replacement case parts 11 described above is formed by the top surface of the core pins 23 shown in FIG. 24. The top faces of a pair of slide cores 24 will mold the first step portion 16.

Furthermore, the second step portion 17 will be formed by flat recessed portions (not shown) formed on both outer sides of the top edge in the core pins 23. And the third step portion 18 will be formed by the upper-end face of the ejector pin 25.

According to the replacement case part 11 shown in FIGS. 25 to 29, the first step portion 16 is molded protruding against the inner bottom face 12*a*, so that when the replacement case part 11 is released from the slide core, the upper end of the slide core 24 slides along the face of the first step portion 16.

Thus, product defects can be prevented, such as slipping scratches onto the inner bottom face 12*a* of the replacement case parts 11 due to the movement of the slide core 24 accompanied by the mold releasing.

Further, the third step portion 18 of the replacement case part 11 is recess-step molded to the inner bottom face 12*a*, and thus the replacement case part 11 released from the slide core 24 can be received in a stable posture by the ejector pin 25 in the recess step-molded third step portion 18.

REFERENCE SIGNS LIST

1 Cover member
1*a* front face plate
1*b* outer leg plate
1*d* case support
1*g* sliding body
1*h* stopper
1*k* recess
1*m* inner bottom face (matte-finished surface)
1*q* guiding recess
2 case body
2*a* rear face plate
2*b* leg plate
2*c* replacement lead accommodation room
2*d* thin-walled portion
2*e* lid body
2*f* case part
2*g* blocking plate
2*j* guide
2*j*1 parallel region
2*j*2 inclined region
2*j*3 returning guide
2*m* sliding protrusion
2*p* multiple protrusions (replacement lead sticking prevention)
2*r* group of protrusions
2*x* operating portions
3 inner lid body
3*b* protection plate
3*d* multiple protrusions (replacement lead sticking prevention)
3*f* rib for sliding
L replacement lead
11 replacement lead case part
12 main face plate
12*a* inner bottom face
13 leg plate
13*a* inner side surface
14 inward protrusion
16 first step portion
17 second step portion
18 third step portion

The invention claimed is:

1. A replacement lead case, comprising:

a case body, in which an inner space enclosed by a back plate and right and left leg plates is used as a replacement lead accommodation room, and a lid body is formed on a tip side and a case part is on a rear side via a bendable thin-walled portion placed near the tip of the back plate in a longitudinal direction, and a cover member, which is formed in a U-shaped cross-section perpendicular to the longitudinal direction by a front face plate and right and left outer leg plates, and in which the replacement lead accommodation room on the case body is covered by the front face plate, and which is slidably supported in the longitudinal direction by positioning the leg plates of the case body inside the outer leg plates, wherein a guide is formed along the longitudinal direction either on at least one of the leg plates in the lid body or on the outer leg plates on the cover member covering the leg plates, and also a sliding body in contact with the guide is formed on either one or the other, and with the sliding action of advancing the lid body of the case body from the tip of the cover member, the sliding contact of the sliding body against the guide causes the lid body to pivot to warp the lid body toward the rear plate through the thin-walled portion.

2. The replacement lead case recited in claim 1, further comprising:

an inner lid body, attached to the right and left leg plates of the case body and covering the replacement lead accommodation room at the front face side, wherein protrusions to prevent accommodated replacement leads from surface contacting are formed on an inner surface of the replacement lead accommodation room side of the rear plate of the case body and an inner surface of the replacement lead accommodation room side of the inner lid body.

3. The replacement lead case recited in claim 1, wherein the guides are formed protruding in a rail form extending along the longitudinal direction outside the leg plates of the lid body, and also, the sliding body is formed protruding to be in contact with the guide at the tip portion of the cover member from which the sliding action advances the lid body, and the sliding action causes the lid body to pivot to warp the lid body toward the rear plate through the thin-walled portion by forming an inclined region on the guide leaving from the rear plate as toward the thin-walled portion from the tip portion.

4. The replacement lead case recited in claim 1, wherein at the tip end side of the lid body, a blocking plate is formed to close the tip end by connecting the right and left leg plates, and the blocking plate is visibly recognizably disposed at the tip end of the cover member, in a state where the lid body is accommodated in the cover member and the front face plate of the cover member is viewed from the front.

5. The replacement lead case recited in claim 1, wherein the case body and the cover member are both made of a resin material, a group of a large number of line protrusions is formed in a direction orthogonal to the longitudinal direction on the backside of the rear plate of the case body, and a circular-shaped recess is formed on the surface of the front face plate of the cover member.

6. The replacement lead case recited in claim 2, wherein a rib for sliding is formed along the longitudinal direction of the inner lid body on the outer surface of the inner lid body, and the inner bottom face of the cover member has a matte-finished surface.

7. The replacement lead case recited in claim 1, wherein the case body is provided with an operation part protruding outwardly from the leg plate; moving the operation part relative to the longitudinal direction of the cover member achieves a sliding motion to advance the lid body of the case body from the tip end of the cover member.

8. The replacement lead case recited in claim 1, wherein the cover member, which is integrally formed of the right and left outer leg plates which are provided on both sides of the front face plate to form the U-shaped cross-section perpendicular to the longitudinal direction, is integrally formed with an inward protrusions which face inwardly toward the right and left outer leg plates, and wherein on an inner bottom face of the front face plate which is located between the right and left outer leg plates of the cover member, a first step portion having a step against the inner bottom face is formed along the right and left outer leg plates except for a central portion of the longitudinal direction of the inner bottom face.

9. The replacement lead case recited in claim 8, wherein a second step portion with a step against the inner surface is formed continuously from the first step portion on the opposing inner surfaces of the right and left outer leg plates.

10. The replacement lead case recited in claim 9, wherein a third step portion, which has a different concavo-convex direction from the first step portion, is formed at a displaced position from the first step portion on the inner bottom face of the front face plate which is located between the right and left outer leg plates.

11. The replacement lead case recited in claim 10, wherein the first step portion protrudes from the inner bottom face, and the third step portion is recessed to the inner bottom face.

* * * * *